United States Patent [19]

Honma et al.

[11] Patent Number: 4,825,189

[45] Date of Patent: Apr. 25, 1989

[54] TRAIN MONITORING EQUIPMENT

[75] Inventors: Hidetoshi Honma; Kenji Morihara, both of Hyogo, Japan

[73] Assignee: Mitsubishi Denki Kabushiki Kaisha, Tokyo, Japan

[21] Appl. No.: 936,846

[22] Filed: Dec. 2, 1986

[30] Foreign Application Priority Data

Dec. 24, 1985 [JP] Japan ..... 60-289189

[51] Int. Cl.[4] ..... B61L 15/00

[52] U.S. Cl. ..... 246/166.1

[58] Field of Search ..... 340/47, 48, 825.07, 340/825.52

[56] References Cited

U.S. PATENT DOCUMENTS

| | | | |
|---|---|---|---|
| 3,453,597 | 7/1969 | Pomerene | 340/825.52 |
| 3,696,758 | 10/1972 | Godinez, Jr. | 340/48 X |
| 4,454,509 | 6/1984 | Buennagel et al. | 340/825.07 X |
| 4,616,223 | 10/1986 | Naaijer | 340/825.07 X |
| 4,656,586 | 4/1987 | Ochiai et al. | 340/48 X |

OTHER PUBLICATIONS

*Railcar-Mounted Train-Monitoring Equipment,* Mitsubishi Electric Advance, (Sep. 1981).

*Primary Examiner*—Joseph A. Orsino
*Assistant Examiner*—Brian R. Tumm
*Attorney, Agent, or Firm*—Wolf, Greenfield & Sacks

[57] ABSTRACT

Train monitoring equipment for a train formed by coupling a plurality of sets of cars of fixed formations, comprising monitoring stations mounted in the respective cars of the train and connected serially by transmission lines. Presetting switches are provided in the respective monitoring stations for presetting the formation numbers of the sets of cars in which the respective monitoring stations are located. One of the monitoring stations which serves as the control station transmits its formation number to the other monitoring stations which then register their station numbers on the basis of conformity or non-conformity of the preset formation numbers with the received formation numbers.

11 Claims, 3 Drawing Sheets

TRAIN MONITORING EQUIPMENT

BACKGROUND OF THE INVENTION

1. Technical Field

The present invention relates to train monitoring equipment, and more particularly to train monitoring equipment enabling the location of a single car to be identified even when a plurality of trains of fixed formations are coupled together.

2. Prior Art

FIG. 1 is a block diagram showing the constitution of train monitoring equipment as shown, for example, on page 496 of "The 19th Transactions of Domestic Symposium on Cybernetics Utilization in Railway Engineering". In the figure, the reference numerals 101 to 108 denote monitoring stations which are respectively in each of the cars numbered 1 to 8. These monitoring stations are connected serially by transmission lines L. These eight cars form a train of fixed formation. The numeral 110 denotes a display unit connected to monitoring station 101 which is mounted in car No. 1, and the numeral 111 a display unit connected to monitoring station 108 mounted in car No. 8.

Because the prior art train monitoring equipment is constituted in the manner described above, that one of monitoring stations 101 or 108 which is mounted in the leading car operates as the control station for transmission control.

Assuming that car No. 1 located at the left end of the train shown in FIG. 1 is the leading car, monitoring station 101 serves as the master control station and monitoring stations 102 to 108 are the slave stations. Monitoring station 101 then interrogates monitoring stations 102 to 108 in sequence through transmission lines L, and collects and edits the information from each of monitoring stations 102 to 108, displaying it on display unit 110. The same information is also displayed on display unit 111 in a suitable way.

Since the station number (for example, one of the series 1 to 8 corresponding to the location of the cars) has been set in advance in each of monitoring stations 101 to 108 by a switch (not shown in the figure), monitoring stations 102 to 108 send back a response (i.e. information on the state of the car in which each monitoring station is mounted) to monitoring station 101, only when the station number of each monitoring station is designated by control station 101, demanding a reply from the designated station. In this case, since each car is assumed to be arranged in the form of the fixed train formation, that is to say, according to the order of the location of each car, it is possible to identify the position of the cars in the fixed formation in which monitoring stations 101 to 108 are mounted.

As described above, since the prior art train monitoring equipment determines the station numbers of the respective monitoring stations 101 to 108 by setting the station numbers to correspond to the location of the respective cars, when a plurality of trains of fixed formation are coupled together for use on a particular route, there are a plurality of monitoring stations having the same station number. This causes a problem of difficulty in transmitting and receiving information between the control station and the slave stations, and in correctly identifying the position of each of the cars which carry the monitoring stations.

SUMMARY OF THE INVENTION

It is therefore a general object of the present invention to solve the above-stated problems.

It is a more specific object of the present invention to provide train monitoring equipment which enables the station number of each monitoring station mounted in the respective cars of a train to be correctly identified and thereby enables the location of the respective cars to be determined even when the train is formed by coupling together two or three trains of fixed formation.

In order to accomplish these objects, the train monitoring equipment of the present invention includes monitoring stations mounted in the respective cars of a train which has been formed by coupling together a plurality of sets of cars each being in a fixed formation. Each monitoring station has a registered number equivalent to the location of the corresponding car in the fixed train formation. A presetting means is provided to be connected to each monitoring station for presetting the formation number assigned to the monitoring station. One of the monitoring stations serves as the control station and transmits to the monitoring stations information concerning at least the formation number of the fixed train formation assigned to the control station. The monitoring stations receive this information and register station numbers therein on the basis of the conformity or non-conformity of the preset formation numbers with the formation number derived from the received information, thereby enabling the control station to identify the location of the respective cars in the train.

In the first embodiment of the present invention, two sets of cars in fixed formation are coupled to form a train. The monitoring station located at the leading end of the train serves as the control station and transmits to the monitoring stations information concerning the direction of running of the train and the formation number of the fixed train formation assumed to the control station. The monitoring stations receive this information and register station numbers therein on the basis of the direction-of-running information and conformity or non-conformity of the preset formation numbers with the formation number derived from the received information.

In the second embodiment of the present invention, three sets of cars in fixed formation are coupled together to form a train. Input means are provided to give to the monitoring stations mounted at the ends of the train an indication that these two stations are located at the leading and rear ends of the train, respectively. One of these two monitoring stations serves as the control station and transmits to the monitoring stations information concerning the direction of running of the train and the formation numbers of the fixed train formations assigned to these two monitoring stations. The monitoring stations receive this information and register station numbers therein on the basis of the direction-of-running information and conformity or non-conformity of the preset formation numbers with either of the formation numbers derived from the received information. An example of a suitable presetting means is a rotary switch capable of outputting binary signals in accordance with the selection of a decimal numeral. Another example of a presetting means is selectively short-circuited pins of a connector used for connecting the monitoring station to the corresponding car. Alternatively, the formation number may be preset by means capable of deriving the formation number from the car number assigned to each car.

In accordance with the present invention, novel train monitoring equipment is provided which is capable of identifying the station numbers of respective monitoring stations and of determining the location of respective cars in the formation of a train, thus enabling accurate grasp of the monitoring information relating to all cars irrespective of the combination in which sets of cars are coupled to form a train of a particular length.

DESCRIPTION OF THE DRAWINGS

The features of the invention which are believed to be novel are set forth with particularity in the appended claims. The invention may best be understood, however, by reference to the following description in conjunction with the accompanying drawings in which:

DESCRIPTION OF THE ILLUSTRATED EMBODIMENTS

Hereafter, one embodiment of the present invention will be described referring to FIG. 2 which is a block diagram showing a preferred embodiment of the present invention.

Figure 1:
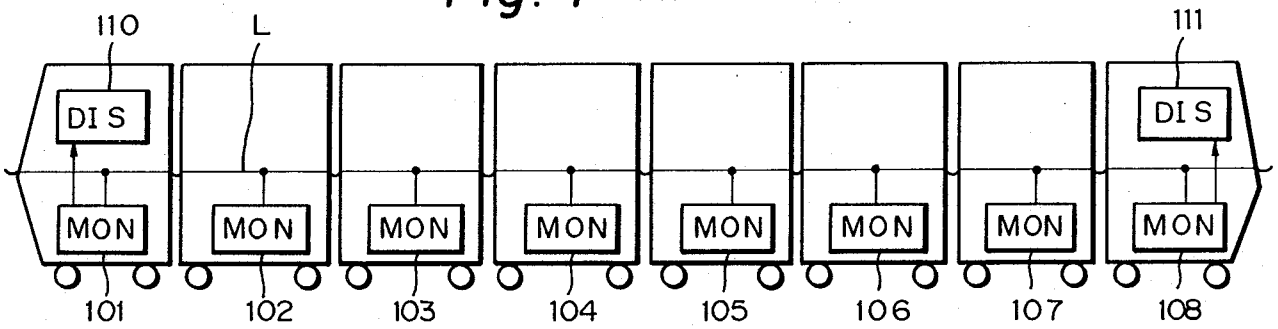
Fig. 1 PRIOR ART
FIG. 1 shows diagrammatically one example of the prior art train monitoring equipment.

In this figure, a train has been formed by coupling together a first set of cars 1 with a first type of fixed formation having four cars with a second set of cars 2 with a second type of fixed formation having two cars. Monitoring stations 11 to 14, 21 and 22 correspond to monitoring stations 101 to 108 of the prior art equipment as shown in FIG. 1, and are connected serially to each other by transmission lines L similar to the ones of the prior art. Each of the monitoring stations is provided with a switch (not shown) for the setting of its location number as assigned in the first or second fixed formation. For example, the numbers 1 to 4 are set in monitoring stations 11 to 14, respectively, by the switches because stations 11 to 14 are respectively mounted in cars No. 1 to No. 4 of the set of cars 1.

Preset switches 11*a* to 14*a*, 21*a* and 22*a* are provided in order to preset in the corresponding monitoring stations the formation number of the fixed formation to which each of the monitoring stations belongs. In the illustrated embodiment, monitoring stations 11 to 14 have the formation number "01" which indicates that these stations are mounted in the set of cars 1 having the first type of train formation, and monitoring stations 21 and 22 have the formation number "02" which indicates that these two stations are mounted in the set of cars 2 having the second type of train formation. In general, the formation number is represented by a number of two or three digits.

Figure 2:
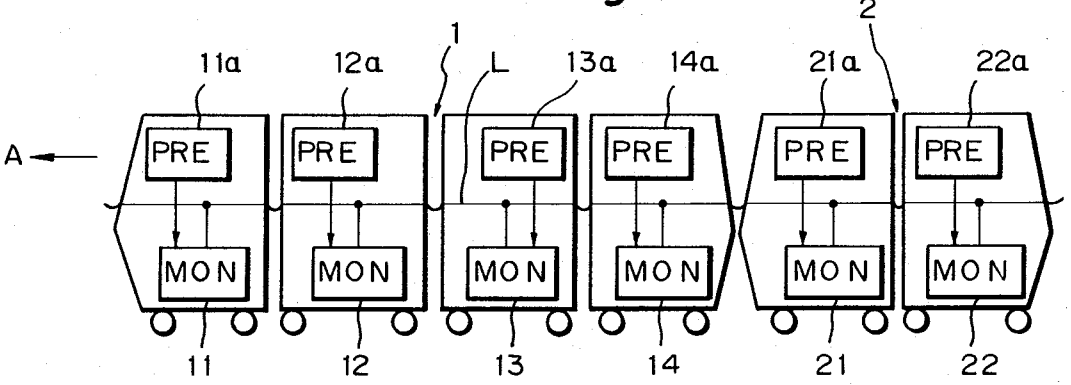
FIG. 2 shows diagrammatically the first embodiment of the train monitoring equipment according to the present invention.

Referring to FIG. 2, the operation will be described assuming that the direction indicated by arrow A (to the left in the figure) is the running direction of the train. In this case, monitoring station 11 which is located in the leading car, that is, the No. 1 car of the first set of cars 1, operates as the control station for transmission control, while other monitoring stations 12 to 14, 21 and 22 operate as the slave stations.

First, monitoring (control) station 11 transmits information about the formation number "01", which indicates that the control station is located in the first set of cars, to other monitoring stations 12 to 14, 21 and 22. At the same time, the information on the running direction of the train indicating that the train is on the up line or the down line is also sent from control station 11. Each of monitoring stations 12 to 14, 21 and 22 receives such information and compares it with the formation number "01" or "02" already preset in each. Each slave station then determines that it either belongs to the same set of cars as control station 11 (if the formation number received from the control station and the formation number preset in each slave station are coincident), or that it does not belong to the same set of cars as the control station (if the received and preset formation numbers are not coincident).

Accordingly, it is possible to discriminate between two cars which have the same location number but belong to different sets of cars.

More specifically, assuming that the "down" train is running in the direction indicated by arrow A in FIG. 2, that is, to the left in the figure, the location numbers are set in descending order in the direction of running. In this case, the formation number of control station 11 coincides with the formation number of monitoring stations 11 to 14 in the first set of cars 1. Then each of monitoring stations 11 to 14 sets the station number to be equivalent to its location number. On the other hand, the formation number of the control station is different from the formation number of monitoring stations 21 and 22 in the second set of cars 2. Thus each of these two stations sets the station number equivalent to its location number with the prefix "1" added thereto. Thus, the station numbers of monitoring stations 11 to 14, 21 and 22 are registered, from left to right, as "1", "2", "3", "4", "11" and "12" in the embodiment of FIG. 2, whereby the registered station numbers of monitoring stations 11 to 14, 21 and 22 do not conflict. Moreover, the station numbers thus registered are arranged in a consistent manner in the direction of running of the train. This enables monitoring station 11 to determine the location of the cars in the overall train formation, that is, where an indicated car is located relative to the leading car, in accordance with the registered station numbers, and to display the state of each car accurately on a display unit (not shown) connected to monitoring station 11.

When the train is running to the right in FIG. 2, that is, when the train is on the "up" line, the location numbers have been set in each set of cars on the basis of this direction-of-running information such as to be in ascending order from left to right. In this case, monitoring station 22 serves as the control station for transmission control, and monitoring stations 21 and 22 set their station numbers to be equivalent to their location numbers with the prefix "1" added thereto, because the formation number of stations 21 and 22 is coincident with the formation number of control station 22. On the other hand, monitoring stations 11 to 14 set their station numbers to be equivalent to their location numbers, because the formation number of stations 11 to 14 is different from the formation number of control station 22.

Accordingly, the station numbers are registered, from left to right, as "1", "2", "3", "4", "11" and "12". This enables control station 22 to determine the location of monitoring stations 11 to 14, 21 and 22, and, therefore, the location of all the cars in the entire train formation, and to display the state of the respective cars accurately on a display unit (not shown) connected to the control station.

Figure 3:
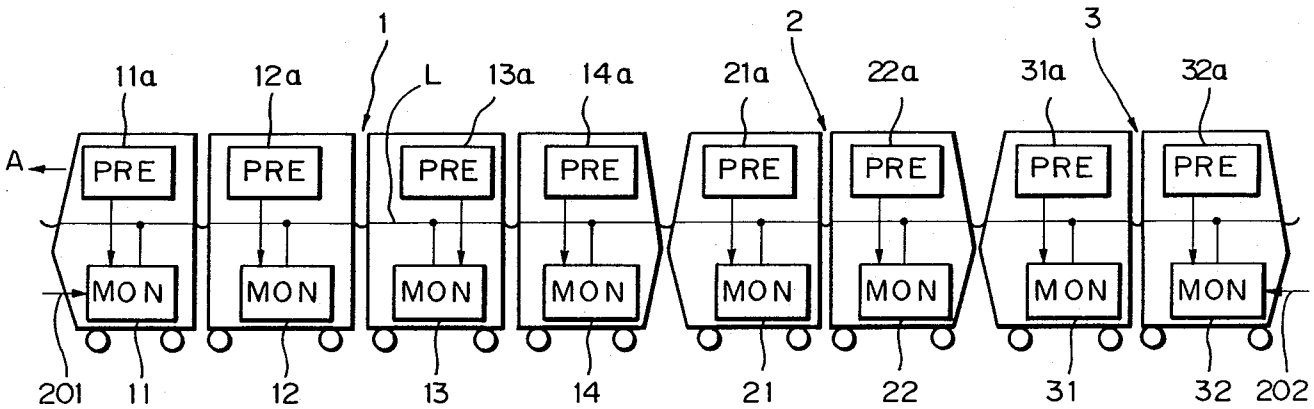
FIG. 3 shows diagrammatically the second embodiment of the train monitoring equipment according to the present invention.

Hitherto, explanation has been made in relation to the coupling of two sets of cars of fixed formation. The present invention, however, is not limited to this kind of combination. Even when three sets of cars are coupled to form a complete train of fixed formation, the train monitoring equipment of the present invention serves to identify the location of a car in such a compositely formed train. FIG. 3 shows the second embodiment of the train monitoring equipment of the present invention which is employed for identifying the location of a car in a train formed by coupling three sets of cars.

In this figure, a train has been formed by coupling three sets of cars 1, 2 and 3. The first set of cars 1 having the first type of fixed formation has four cars, while the second set of cars 2 having the second type of fixed formation has two cars, and the third set of cars 3 also has two cars. Similar to the monitoring equipment shown in FIG. 2, the respective cars carry monitoring stations 11 to 14, 21, 22, 31 and 32 connected serially by transmission lines L. The location number is set to the corresponding monitoring station by a switch (not shown). For example, "1" is set in monitoring stations 11, 21 and 31, "2" is set in monitoring stations 12, 22 and 32, "3" is set in monitoring station 13, and "4" is set in monitoring station 14. Present switches 11*a* to 14*a*, 21*a*, 22*a*, 31*a* and 32*a* are provided for the respective monitoring stations for presetting the train formation numbers therein. For example, the formation number "01" is set in monitoring stations 11 to 14, the formation number "02" is set in monitoring stations 21 and 22, and the formation number "03" is set in monitoring stations 31 and 32. As is the case in the first embodiment shown in FIG. 2, the formation number is represented by a number of two or three digits.

In the second embodiment shown in FIG. 3, monitoring stations 11 and 32 mounted in the leading and rear cars of the train are supplied with information 201 and 202 indicating that these monitoring stations are mounted in the end cars of the train. For example, it is possible to utilize for such information signals generated when the power supply switch for the devices in the motorman's console is switched on, that is, signals accompanying the power supply provided to such devices as are used only in the leading and rear cars (for example, train radio telephone equipment, an A.T.C. or a circuit for instructing the opening and closing of doors). Such signals enable monitoring stations 11 and 32 to detect the fact that they are located at the ends of the train formation.

Assuming that the train is running in the direction indicated by arrow A (i.e. to the left), the operation of the second embodiment will next be explained. In this case, monitoring station 11 mounted in the leading car (car No. 1 in the first set of cars) is determined to operate as the control station for transmission control, and the remaining monitoring stations operate as the slave stations. First, monitoring station 11 sends a signal through transmission lines L to monitoring station 32 located at the opposite end of the train, and waits for a response signal from monitoring station 32. As described above, there are only the two stations 11 and 32 which have detected the fact that they are located at the ends of the train, and in this case monitoring station 11 is assumed to operate as the control station. Accordingly, it is determined that only monitoring station 32 is allowed to send back a reply. In response to the signal from monitoring station 11, monitoring station 32 transmits to monitoring station 11 a signal representing the formation number "03" of the third set of cars to which monitoring station 32 belongs. This response signal is received by monitoring station 11 and enables it to know the formation number "03" of the third set of cars in which monitoring station 32 at the rear end is located, as well as the formation number "01" of the first set of cars in which control station 11 is located.

Next, monitoring station 11 transmits information about both formation number "01" (its own) and formation number "03" (of monitoring station 32) to the respective monitoring stations 12 to 14, 21, 22, 31 and 32. At the same time, control station 11 sends to the remaining monitoring stations information concerning the direction of running of the train, that is, information indicating that the train is travelling "up" or "down". Monitoring stations 12 to 14, 21, 22, 31 and 32 receive such information and compare the received information with the formation number "01", "02" or "03" preset in these monitoring stations. If the formation number of a certain monitoring station coincides with the formation number "01" derived from the received information, that monitoring station detects the fact that it belongs to the same set of cars as the control station. On the other hand, if the formation number of a certain monitoring station coincides with the formation number "03" derived from the received information, that station detects the fact that it belongs to the same set of cars as monitoring station 32 which is at the other end of the train relative to the control station. If no coincidence occurs between the formation number of a certain monitoring station and the formation number "01" or "03" derived from the received information, that station detects the fact that it belongs to the intermediate set of cars. In accordance with the results of detection regarding which set of cars each monitoring station belongs to, the station numbers are set in the respective monitoring stations. Where the train is travelling in the "down" direction i.e. to the left in FIG. 3, it is assumed that the location numbers have been set in the respective monitoring stations in each set of cars in descending order in the direction indicated by arrow A. Then, the numbers equivalent to the location numbers of monitoring stations 11 to 14 are set therein as their respective station numbers on the basis of the coincidence between the formation number of these stations and the formation number "01" derived from the received information. The numbers equivalent to the location numbers of monitoring station 31 and 32 with the prefix "2" added thereto are set therein as their respective station numbers on the basis of the coincidence between the formation number of these stations and the formation number "03" derived from the received information. Monitoring stations 21 and 22 register their station numbers which are equivalent to their location numbers with the prefix "1" added thereto. In other words, the registered station numbers of the monitoring stations are "1", "2", "3", "4", "11", "12", "21" and "22" from the left end to the right end.

Therefore, no duplication of station numbers occurs in registering them in the monitoring stations, and the registered station numbers are arranged in the fixed order coincident with the direction of running of the train. Thus, it becomes possible for the control station (monitoring station 11) to identify the location of each of the cars in the train formation, that is, to determine where the car in question is located in the overall train formation on the basis of the station numbers registered in the monitoring station. Also it is possible to display the state of the respective monitoring stations accurately on a display unit (not shown) connected to monitoring station 11.

In the case where the train is travelling on the "down" line, i.e. to the right in FIG. 3, monitoring station 32 serves as the control station and the location numbers in each fixed train formation are set in ascending order in the direction of running of the train. In this case, the station numbers which are equivalent to the location numbers of monitoring stations 31 and 32 with the prefix "2" added thereto are registered therein, because the formation number thereof coincides with the formation number of control station 32. Monitoring stations 11 to 14 register the station numbers equivalent to the respective location numbers thereof, because the formation number thereof coincides with the formation number of monitoring station 11 at the end opposite to that of the control station. The station numbers registered in monitoring stations 21 and 22 are equivalent to the location numbers thereof with the prefix "1" added thereto, because there is no coincidence between the formation number thereof and the formation number of monitoring station 32 or 11. In other words, the registered station numbers are "1", "2", "3", "4", "11", "12", "21" and "22" in order from the left end to the right end, thus enabling the discrimination of the location of the respective cars and accurate display of the state of the respective monitoring stations on a display unit (not shown) of the control station.

Figure 4:
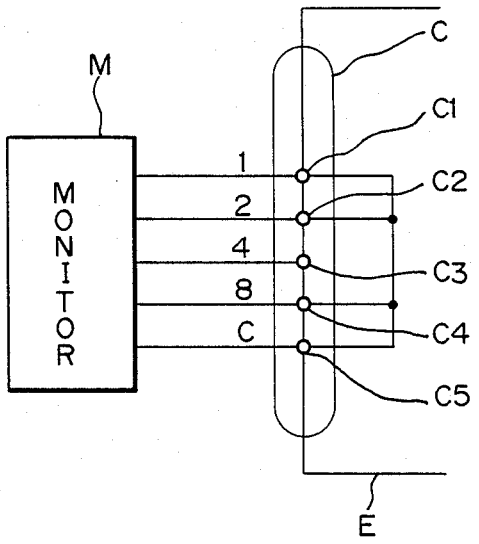
FIG. 4 shows an example of the formation number presetting means used in the train monitoring equipment of the present invention.

In the first and second embodiments described above, the formation numbers are set in monitoring stations 11 to 14, 21, 22, 31 and 32 by preset switches 11*a* to 14*a*, 21*a*, 22*a*, 31*a* and 32*a*. An example of the preset switches is such a well-known rotary switch as that which is adapted to output a binary code corresponding to a number selected from predetermined decimal numerals (for example, 0 to 9). The rotary switch of this type can also be used for setting the location number in the corresponding monitoring station. The present invention, however, is not intended to be limited to adoption of the rotary switches described above for these presetting and setting means. If the monitoring stations are connected to the corresponding car-mounted equipment by connectors, the location numbers and/or formation numbers can be established by short-circuiting between selected pins of the respective connectors. More specifically, as shown in FIG. 4, monitoring station M is connected to pins C1 to C5 of connector C of car-mounted equipment E through a plurality of lines, and interconnections are preliminarily made between pins C1 and C2, between pins C2 and C4 and between pins C4 and C5. If pins C1, C2 and C4 output the binary signals corresponding to one, two and eight, respectively, and pin C5 serves as the common grounded terminal, monitoring station M reads the binary coded signal corresponding to eleven ($=1+2+8$). Thus, monitoring station M utilizes this binary coded signal for setting the location number or presetting the formation number.

Figure 5:
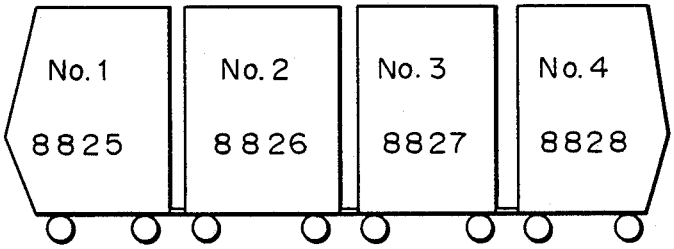
FIG. 5 is used to explain a way of deriving the formation number to be preset in the monitoring stations of the train monitoring equipment of the present invention.

The car number of each car may be obtained from information representing the type of car. This information is of the regular sort by which the respective monitoring stations 11 to 14, 21, 22, 31 and 32 are able to derive the numbers thereof, such as TC1 (car No. 1 without a motor and with a driver's seat), M1 (car No. 1 with a motor) and M2 (car No. 2 with a motor). Further, the formation number can be obtained from information which is sufficiently standard to allow the number which serves to identify each set of cars to be derived therefrom. One example of this information is the car number assigned to each car which serves as an administration number consisting of a plurality of figures. For example, the administration numbers 8825, 8826, 8827 and 8828 (FIG. 5) are assigned to the car Nos. 1 to 4, respectively. These cars form a fixedly coupled set. Since these administration numbers comprise a serial number, the subtraction of the location number (1, 2, 3 or 4) from the administration number for each car results in the same number (in this case, 8824). This common number is then used as the formation number.

While the invention has been particularly shown and described with reference to preferred embodiments thereof, it will be understood by those skilled in the art that various modifications may be made therein, and it is intended to cover in the appended claims all such modifications as fall within the true spirit and scope of the invention.

We claim:

1. Train monitoring equipment for a train including a first set of cars and a second set of cars, said first and second set of cars comprising respectively a plurality of cars coupled together, wherein the cars of said first set have a first formation number and the cars of said second set have a second formation number different from said first formation number, said train monitoring equipment comprising:

monitoring stations which are respectively mounted in each of said cars and each of which registers the number representing the location of the corresponding car;

transmission lines for connecting said monitoring stations serially; and formation number presetting means for presetting said first formation number in said first set of cars and said second formation number in said second set of cars for discriminating between said first and second sets of cars.

2. Train monitoring equipment for a train including a first set of cars, a second set of cars and a third set of cars, said first set of cars having a first formation number, said second set of cars having a second formation number different from said first formation number, and said third set of cars having a third formation number different from said first and second formation numbers, said train monitoring equipment comprising:

monitoring stations which are respectively mounted to each of said cars and each of which registers the number representing the location of the corresponding car;

transmission lines for connecting said monitoring stations serially;

formation number presetting means for presetting said first formation number in said first set of cars, said second formation number in said second set of cars, and said third formation number in said third set of cars for discriminating between said first, second and third sets of cars; and input means for providing the two monitoring stations mounted in the leading and the rear cars of said train with information indicating that said two monitoring stations are respectively located at the ends of said train.

3. Train monitoring equipment according to claim 1 or 2 wherein said formation number presetting means are preset switches which are respectively provided in each monitoring station.

4. Train monitoring equipment according to claim 1 or 2 wherein said formation number presetting means are selectively short-circuited pins of connectors used for connecting said monitoring stations to the corresponding cars.

5. Train monitoring equipment according to claim 1 or 2 wherein said formation number presetting means are means capable of deriving the formation numbers from the car numbers assigned to the respective cars.

6. Train monitoring equipment for a train comprising a plurality of sets of cars of fixed formations coupled together, each of said sets of cars having a formation number and a plurality of cars, each of said formation numbers being different from one another, said train monitoring equipment comprising:

monitoring stations which are respectively mounted in each of said cars and each having a registered number representing the location of the corresponding car in the fixed formation;

formation number presetting means for presetting in said monitoring stations of each of said sets of cars, said formation number corresponding to the set of cars to which the respective monitoring stations belong; and transmission lines for connecting said monitoring stations serially;

wherein one of said monitoring stations serves as the control station and transmits to said monitoring stations information concerning at least the formation number of the set of cars to which the control station belongs, and wherein said monitoring stations receive said information from the control station and register station numbers thereon on the basis of the formation numbers preset by said formation number presetting means and the formation number derived from the received information, thereby enabling said control station to identify the location of said monitoring stations in said train.

7. Train monitoring equipment according to claim 6, wherein said train comprises two sets of cars of fixed formations coupled together, wherein the monitoring station mounted in the leading car of said train serves as the control station and transmits to said monitoring stations information concerning the direction of running of said train and the formation number of the set of cars to which the control station belongs, and wherein said monitoring stations receive said information and register station numbers therein on the basis of the direction-of-running information and conformity or nonconformity of the preset information numbers with the formation number derived from the received information.

8. Train monitoring equipment according to claim 6, wherein said train comprises three sets of cars of fixed train formation coupled together, wherein the monitoring stations mounted in the leading and the rear cars of said train are supplied from input means with information indicating that said two monitoring stations are located at the ends of said train, wherein one of said two monitoring stations serves as the control station and transmits to said monitoring stations information concerning the direction of running of said train and the formation numbers of the fixed train formation to which said two monitoring stations belong, and wherein the monitoring stations receive said information from the control station and register station numbers therein on the basis of the direction-of-running information and conformity or inconformity of the preset formation numbers with either one of the received formation numbers.

9. Train monitoring equipment according to any one of claims 6–8 wherein said formation number presetting means are preset switches which are respectively provided in each monitoring station.

10. Train monitoring equipment according to any one of claims 6–8 wherein said formation number presetting means are selectively short-circuited pins of connectors used for connecting said monitoring stations to the corresponding cars.

11. Train monitoring equipment according to any one of claims 6–8 wherein said formation number presetting means are means capable of deriving the formation number from the car numbers assigned to the respective cars.

* * * * *